US005524450A

United States Patent [19]

Chen

[11] Patent Number: 5,524,450

[45] Date of Patent: Jun. 11, 1996

[54] AIR-CONDITIONING CEILING FAN

[76] Inventor: Tze L. Chen, P.O. Box 82-144, Taipei, Taiwan

[21] Appl. No.: 547,129

[22] Filed: Oct. 24, 1995

[51] Int. Cl.[6] ..... F25D 23/12

[52] U.S. Cl. ..... 62/259.1; 62/DIG. 16; 165/53

[58] Field of Search ..... 62/259.1, DIG. 16, 62/404, 407, 419, 426, 331; 165/53

[56] References Cited

U.S. PATENT DOCUMENTS

| | | | |
|---|---|---|---|
| 2,756,569 | 7/1956 | Kritzer | 62/259.1 |
| 3,267,995 | 8/1966 | Maudlin | 62/259.1 |

*Primary Examiner*—John M. Sollecito
*Attorney, Agent, or Firm*—Alfred Lei

[57] ABSTRACT

An air-conditioning ceiling fan including a body portion provided with an electric motor and a plurality of blades, an evaporator mounted on the body portion, a hollow supporter adapted to be fixedly mounted on a ceiling and having a tubular lower end depending downwardly through the evaporator, a water tray arranged under the evaporator, a condensing case including a compressor, a condenser and an exhaust fan, the compressor being connected between the condenser and the evaporator via refrigerant pipes, the condenser being connected with the evaporator via refrigerant pipes, and a connecting pipe connecting the hollow supporter and the condensing case.

1 Claim, 3 Drawing Sheets

AIR-CONDITIONING CEILING FAN

BACKGROUND OF THE INVENTION

1. Field of the Invention

This invention relates to a ceiling fan which can regulate humidity and temperature in buildings.

2. Description of the Prior Art

The conventional ceiling fan includes an electric motor suspended on a ceiling and a plurality of blades drivingly connected and disposed under the electric motor. As the blades are rotated by the motor, a current of air will be set up for ventilating or cooling. However, such a ceiling fan suffers from the following drawbacks:

1. When used in a badly ventilated room, the ceiling fan will not be able to lower the temperature thereby rendering it useless.

2. As the ceiling fan has been running for a long period of time, the motor will become hot thus increasing the temperature of the air current and therefore making the ceiling fan useless.

Therefore, it is an object of the present invention to provide an air-conditioning fan which can obviate and mitigate the above-mentioned drawbacks.

SUMMARY OF THE INVENTION

This invention relates to an air-conditioning ceiling fan.

It is the primary object of the present invention to provide an air-conditioning ceiling fan which can regulate humidity and temperature in buildings.

It is another object of the present invention to provide an air-conditioning ceiling fan which enables the motor to work at a lower temperature thereby increasing its efficiency and service life.

It is still another object of the present invention to provide an air-conditioning ceiling fan which is easy to assemble.

It is still another object of the present invention to provide an air-conditioning ceiling fan which is low in cost.

It is a further object of the present invention to provide an air-conditioning ceiling fan which is convenient to use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
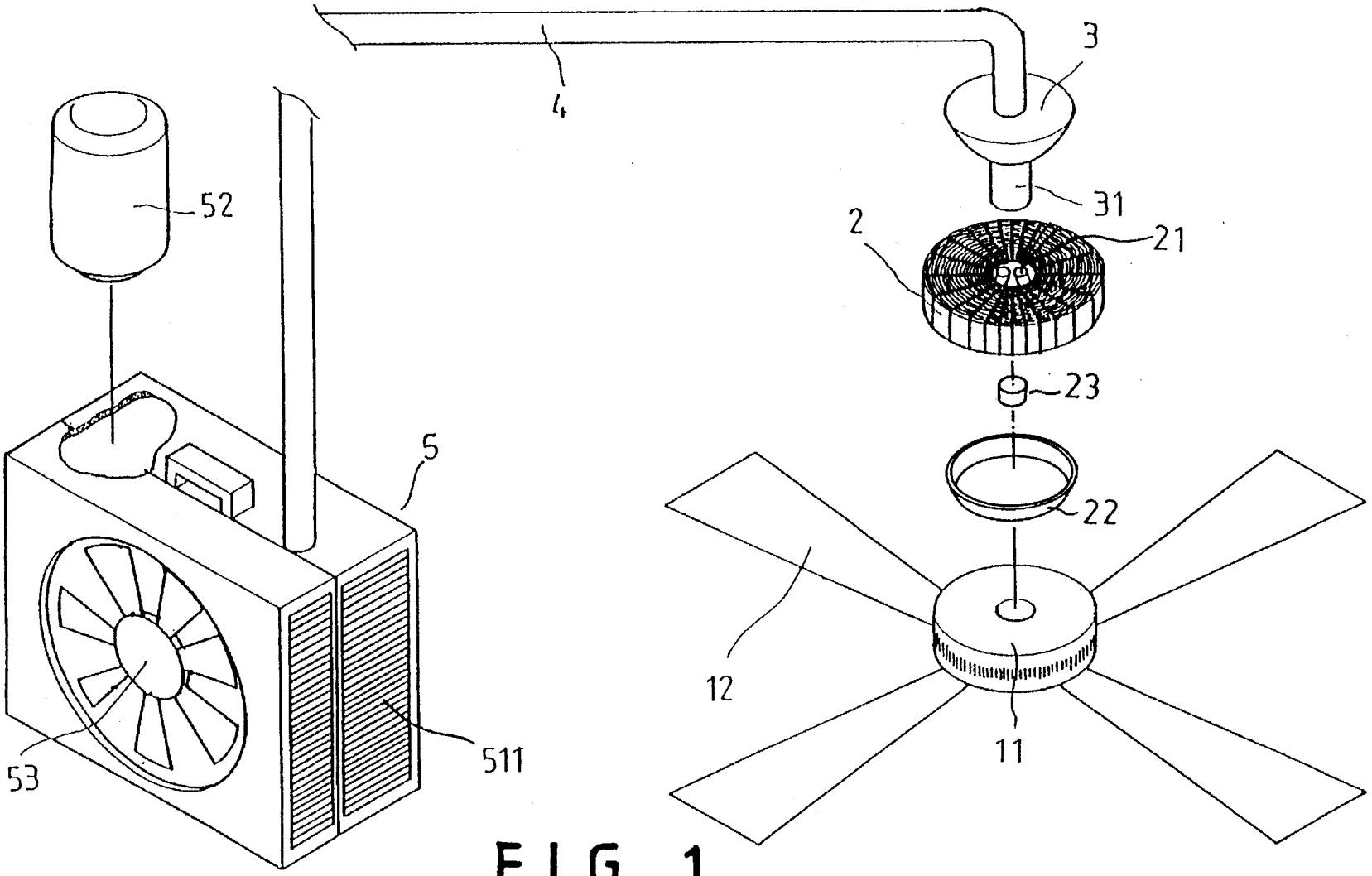
FIG. 1 is an exploded view of the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the air-conditioning ceiling fan according to the present invention mainly comprises a body portion 1, an evaporator 2, a hollow supporter 3, a connecting pipe 4, and a condensing case 5.

The body portion 1 includes an electric motor 11 and a plurality of blades 12 which are drivingly connected and disposed under the electric motor 11. The evaporator 2 is provided with a refrigerant pipe 21. Under the evaporator 2 there is a water tray 22 which is connected with a pump 23. The hollow supporter 3 is provided at the lower end with a tubular portion 31 depending downwardly through the evaporator 2 for enclosing the refrigerant pipe 21 of the evaporator 2 and the electrical cord of the motor 11. Within the connecting pipe 4 there are a plurality of refrigerant pipes. Within the condensing case 5 there are mounted a compressor 52, a condenser 51 and an exhaust fan 53. Furthermore, the condensing case 5 is formed with a plurality of ventilation holes 511.

Figure 2:
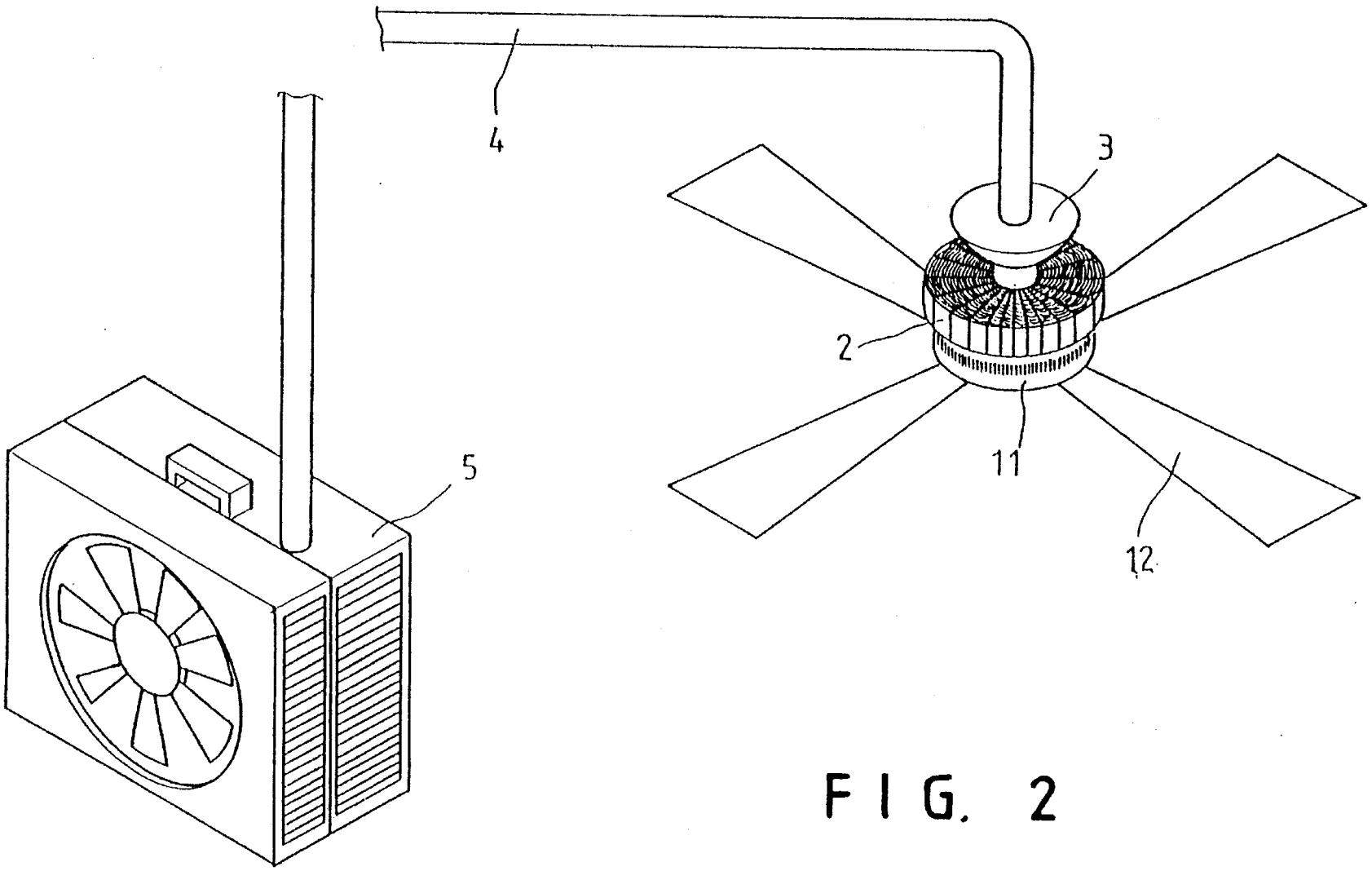
FIG. 2 is a perspective view of the present invention.

FIG. 2 is a perspective view of the present invention. As illustrated, the evaporator 2 is arranged above the motor 11. The hollow supporter 3 is designed for fixedly mounting on the ceiling. The lower end of the hollow supporter 3 is provided with a tubular portion 31 extending through the evaporator 2 to the motor 11. The connecting pipe 4 is connected between the condensing case 5 and the hollow supporter 3.

Figure 3:
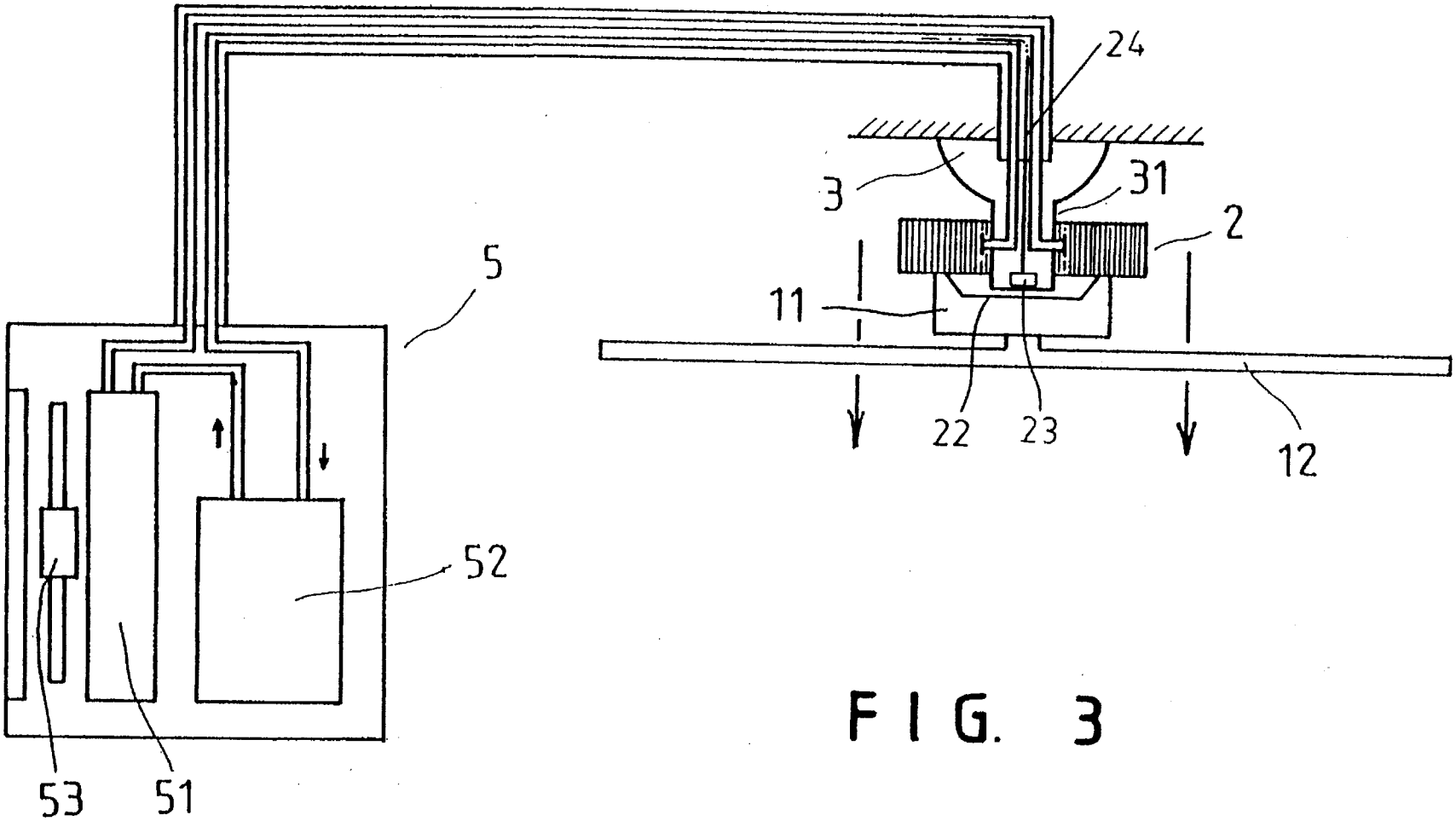
FIG. 3 is a sectional view of the present invention.

As illustrated in FIG. 3, the compressor 52, the evaporator 2 and the condenser 51 are connected by refrigerant pipes 21 enclosed within the connecting pipe 4. The compressor 52 circulates a refrigerant from the evaporator 2 through the condenser 51 in the condensing case 5 and expansion valve (not shown) and back to the evaporator 2. As the refrigerant flows through the evaporator 2, the refrigerant evaporates and gets cold thereby taking heat from the air and making its moisture condense into water droplets which are received in the water tray 23. The blades 12 is driven by the motor 11 to draw the cool dry air downward. The exhaust fan 53 is used for removing the heat from the condenser 51 outside the room.

However, it should be noted that the circulation of the refrigerant can be reversed so as to make the fan send out warn air.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An air-conditioning ceiling fan comprising:

a body portion including an electric motor and a plurality of blades drivingly connected and arranged under said electric motor;

an evaporator mounted on said body portion;

a hollow supporter adapted to be fixedly mounted on a ceiling and having a tubular lower end depending downwardly through said evaporator;

a water tray arranged under said evaporator;

a condensing case including a compressor, a condenser and an exhaust fan, said compressor being connected between said condenser and said evaporator via refrigerant pipes, said condenser being connected with said evaporator via refrigerant pipes; and a connecting pipe connecting said hollow supporter and said condensing case.

* * * * *